US005144699A

United States Patent [19]

Graham

[11] Patent Number: 5,144,699

[45] Date of Patent: Sep. 8, 1992

[54] PLUMBING DRAINAGE SYSTEM

[76] Inventor: Kenneth Graham, 1523 Central Park Ave., Yonkers, N.Y. 10710

[21] Appl. No.: 556,650

[22] Filed: Jul. 20, 1990

[51] Int. Cl.[5] ..... E03D 11/00

[52] U.S. Cl. ..... 4/256.1; 137/584; 137/613; 138/92; 251/145; 4/255.01

[58] Field of Search ..... 4/255, 256, 257, DIG. 7, 4/653, 211; 137/584, 614.2, 315, 317, 320, 613, 614, 238, 240, 242, 244, 360, 361, 362; 138/89, 92; 285/13; 251/145, 147; 141/38

[56] References Cited

U.S. PATENT DOCUMENTS

| | | | |
|---|---|---|---|
| Re. 32,041 | 11/1985 | Heckmann et al. | 137/625.18 X |
| 163,737 | 5/1875 | Butler | 137/247.51 |
| 374,008 | 11/1887 | Schuyler | 137/357 |
| 528,335 | 10/1894 | Montgomery | 137/247.51 |
| 705,933 | 7/1902 | Keyt | 137/240 |
| 738,289 | 9/1903 | Buckley et al. | 137/247.43 |
| 1,016,342 | 2/1912 | Lyons | 137/247.43 |
| 1,634,530 | 7/1927 | Anderson | 137/247.51 |
| 1,885,977 | 11/1932 | Denison | 137/240 |
| 3,306,316 | 2/1967 | Stillwagon | 137/613 |
| 3,770,014 | 11/1973 | Limberg | 137/613 X |
| 3,936,892 | 2/1976 | Miller | 4/256 X |
| 3,946,986 | 3/1976 | Sutter et al. | 251/304 X |
| 4,059,250 | 11/1977 | Guldener et al. | 251/304 |
| 4,193,580 | 3/1980 | Norris et al. | 251/304 X |
| 4,194,535 | 3/1980 | Gallard et al. | 137/595 X |
| 4,546,789 | 10/1985 | Taylor | 137/245.5 |
| 4,917,147 | 4/1990 | Jerkins | 137/584 |

OTHER PUBLICATIONS

Babbitt, Harold E.; Plumbing, 1928, pp. 91-92.

Blendermann, Louis; Design of Plumbing and Drainage Systems, 1959, pp. 101-107.

*Primary Examiner*—Henry J. Recla

*Assistant Examiner*—Glenn T. Barrett

*Attorney, Agent, or Firm*—Herbert L. Lerner; Laurence A. Greenberg

[57] ABSTRACT

A plumbing drainage system has a plumbing stack with a clean-out hole formed therein. A drainage device for controlled drainage of the plumbing stack includes a device for connecting the drainage device to a plumbing stack at the clean-out hole formed in the plumbing stack. A shut-off valve is connected downstream of the first connecting device. A second connecting device is connected downstream of the shut-off valve for connection to a drainage hose.

15 Claims, 2 Drawing Sheets

PLUMBING DRAINAGE SYSTEM

BACKGROUND OF THE INVENTION

1. Field of the Invention

The invention relates to a plumbing drainage system used for plugging clean-out holes in plumbing stacks. The invention does not deal with fresh water being supplied under pressure, but rather strictly with drainage of standing liquid and solids.

2. Description of the Related Art

Plumbing stacks, which include both soil stacks that are connected to toilets and waste stacks that are connected to roof drains, often have vertical sections that run for hundreds of feet in large industrial, commercial and residential buildings. Plumbing codes require clean-out plugs to be placed in the stacks at given distances, such as a maximum of 50 feet. Furthermore, such stacks may have turns which are conducive to clogging and therefore clean-out holes are additionally placed upstream of the turns.

In the prior art, the clean-out holes have merely been closed with plugs that are normally screwed in place. However, when a plug is removed, such as because of a clog, the liquid and solids which have backed up in the stack above the clog spray out into the surroundings with a force that is dependent on the height of the standing column of liquid and solids in the stack. For example, in office buildings, stacks normally turn in the ceiling above the lobbies, forming a location that is prone to clogging. The column of water, which may be 200 feet or more in a pipe having a diameter of 3–4 inches, sprays into the lobby with great force. This results in unsanitary drain water or sewage which may carry germs filling the lobby.

U.S. Pat. Nos. 163,737 and 528,335 show conventional plugs which have male threads that are screwed into female threads in sink traps. Similar plugs have been used for many years in plumbing stacks.

In U.S. Pat. No. 1,634,530, a plug is provided in a drain trap which may be opened and closed by a lever mechanism remote from the plug. However, like the plugs discussed above, there is no way of controlling the liquid being emptied from the drain trap once the plug is opened.

Finally, U.S. Pat. Nos. 738,289 and 1,016,342 disclose drain lines in floors having clean-out holes leading to cups or canisters which may be accessed by removing a cover that is flush with the floor. However, the cups or canisters are of limited size and therefore can only hold a limited amount of liquid and solids. Furthermore, there is no way of removing the liquids and solids that have filled the cups or canisters. If used in a plumbing stack, such cups or canisters would quickly overflow.

SUMMARY OF THE INVENTION

It is accordingly an object of the invention to provide a plumbing drainage system, which overcomes the hereinafore-mentioned disadvantages of the heretofore-known devices of this general type and which prevents contamination of the environment from liquid and solids in plumbing stacks by controlling drainage of the stacks.

With the foregoing and other objects in view there is provided, in accordance with the invention, in a plumbing drainage system having a plumbing stack with a clean-out hole formed therein, a drainage device for controlled drainage of the plumbing stack, the drainage device comprising first means for connecting the drainage device to a plumbing stack at a clean-out hole formed in the plumbing stack, a shut-off valve connected downstream of the first connecting means, and second connecting means connected downstream of the shut-off valve for connection to a drainage hose. Through the use of the invention, a hose may be connected to the stack through the drainage device before the valve is opened, so that standing liquid and solids are drained through the hose. The drainage device may then be removed for dislodging the clog through the clean-out hole, without the danger of contaminants being sprayed into the environment.

In accordance with another feature of the invention, there is provided a check valve connected between the valve and the second connecting means. Plumbing codes normally prohibit fixtures from draining into a stack. The check valve ensures that a fixture will not be drained through the second connecting means, because a flow toward the stack will be prevented.

In accordance with a further feature of the invention, the shut-off valve is a ball valve. Such valves are preferred because they provide an opening that is the full size of the pipe to which they are connected.

In this way the valve may be fully opened with only a quarter turn.

In accordance with an additional feature of the invention, the shut-off valve has two valve spindles. This features ensures that access to a spindle will be possible, regardless of the position occupied by the drainage device in relation to the stack.

In accordance with yet another feature of the invention, the first connecting means is a nipple to be connected into the clean-out hole. Clean-out holes are normally threaded for a plug, so that a threaded nipple may be used to replace a plug without reconstructing the stack. The nipple may be connected to the stack by screwing, welding, soldering, brazing, gluing or through the use of lead, a grooved connection or any other suitable means.

In accordance with yet a further feature of the invention, the nipple has a male thread to be screwed into a female thread in the clean-out hole. Clean-out holes are normally threaded for a plug, so that a threaded nipple may be used to replace a plug without reconstructing the stack.

In accordance with yet an added feature of the invention, there is provided a cap to be screwed onto the second connecting means. The cap protects the threads of the second connecting means and assures that leakage of the valve will not result in liquid exiting the drainage device.

In accordance with a concomitant feature of the invention, there are provided means for separating the first connecting means from the shut-off valve. In this way, most of the drainage device may be removed from the stack after draining liquid and solids. This provides easy access to the clean-out hole.

With the objects of the invention in view, there is also provided a combination plumbing stack with a clean-out hole formed therein and a drainage device for controlled drainage of the plumbing stack. With the objects of the invention in view, there is furthermore provided a plumbing drainage device for controlled drainage of a plumbing stack having a clean-out hole formed therein. It is thus seen that the invention is conceived of as both a combination of a stack and a drainage device, as well as a drainage device alone.

Other features which are considered as characteristic for the invention are set forth in the appended claims.

Although the invention is illustrated and described herein as embodied in a plumbing drainage system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2B:
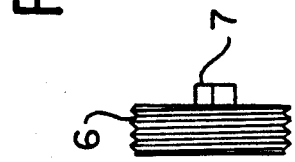
FIG.2b PRIOR ART
Figure 2A:
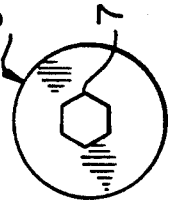
FIG.2a PRIOR ART
Figure 4:
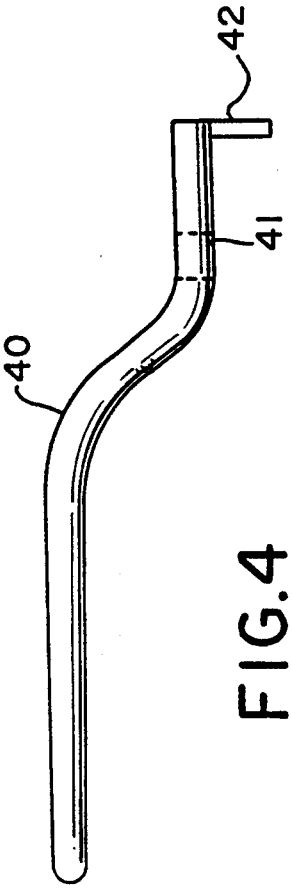
Figure 3:
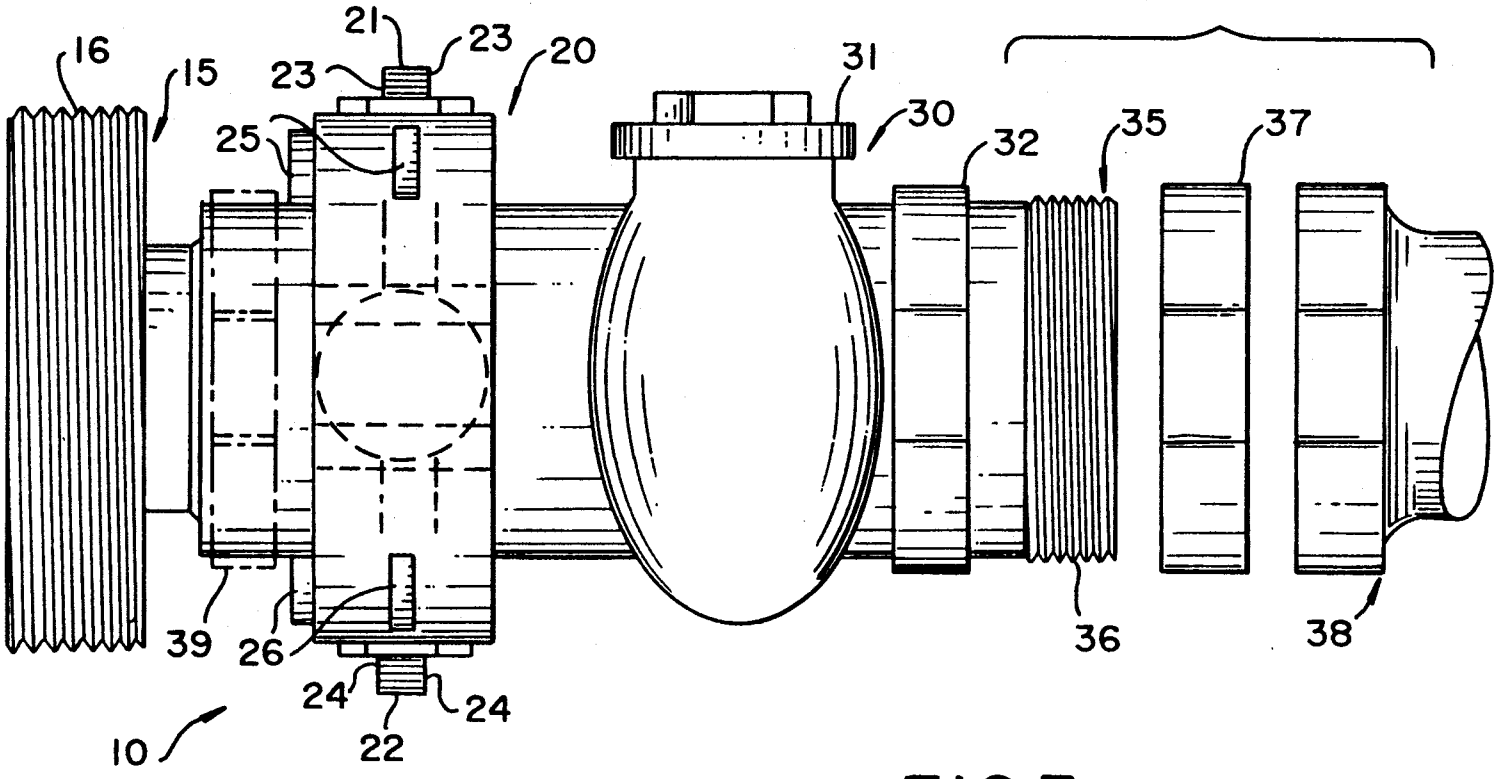

FIGS. *2a* and *2b* are front-elevational and side-elevational views of a conventional plug for the plumbing stack;

FIG. 3 is an enlarged, side-elevational view of the plumbing drainage device according to the invention; and FIG. 4 is a side-elevational view of a key for the plumbing drainage device of FIG. 3.

DESCRIPTION OF THE PREFERRED EMBODIMENTS

Figure 1:
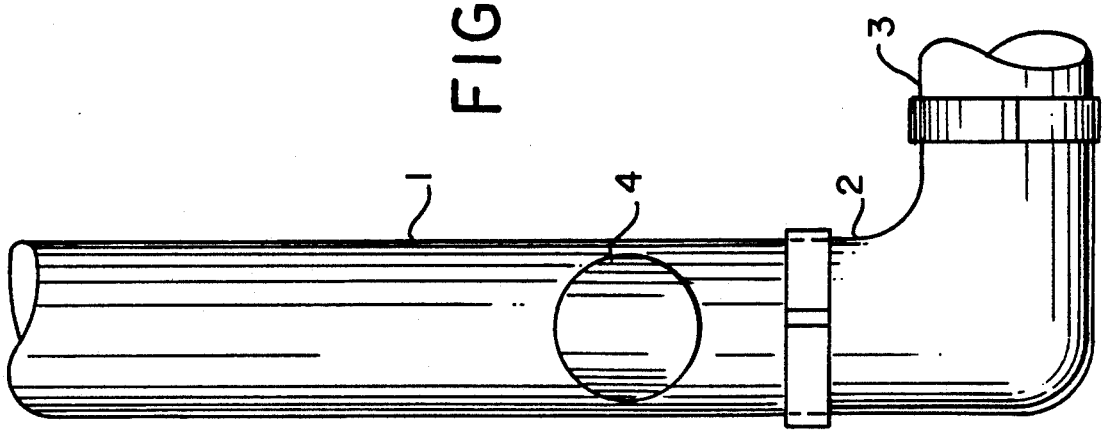
FIG. 1 is a fragmentary, diagrammatic, front-elevational view of a conventional plumbing stack.

Referring now to the figures of the drawings in detail and first, particularly, to FIG. 1 thereof, there is seen a plumbing stack of the type that is used in a multi-story building. A plumbing stack in this context is understood to include soil stacks which are connected to toilets and waste stacks which are connected to roof drains. The stack is normally made of steel and is 3–4 inches in diameter. However, it may be made of iron, copper, PVC, lead or any other rigid material which is normally used for pipes.

It is often necessary to change the direction of the stack. For instance, a stack which runs down the center of a building must change direction to avoid the lobby of the building.

FIG. 1 accordingly shows a stack section 1, an elbow 2 which is screwed on the stack section 1 and another stack section 3 which is screwed on the elbow. Instead of screw threads, the stack sections may be held together by welding, soldering, brazing, gluing or through the use of lead or a grooved connection.

Due to the change in direction brought about by the elbow 2, such stack sections often become clogged. Therefore, a clean-out hole 4 which is approximately 3–4 inches in diameter is formed in the pipe section 1 upstream of the elbow 2. Plumbing codes also require the use of clean-out holes at given maximum distances, such as every 50 feet. A plug 5 shown in FIGS. *2a* and *2b* has male threads 6 which are screwed into non-illustrated female threads at the clean-out hole 4 in the stack section 1. In order to insert or remove the plug 5, a stub 7 is formed thereon for engagement by a wrench. Again, instead of screw threads, the plug may be held in the hole 4 by welding, soldering, brazing, gluing or through the use of lead or a grooved connection with the stack section.

It is thus seen that when a clean-out plug 5 is removed, 200 feet or more of liquid and solids upstream of the clog may be released. This may lead to the flooding of industrial, commercial or residential space with unsanitary or even life-threatening liquid and solids, depending on the type of stack being drained.

According to the invention, a plumbing drainage device 10 is used to drain out the liquid and solids from the stack in a controlled manner, without flooding. The device 10 includes first connecting means in the form of a nipple 15 having a male thread 16 to be screwed into the clean-out hole 4 as an inlet. As mentioned above, instead of using a screw thread 16, the nipple 15 may be held in the hole 4 by welding, soldering, brazing, gluing or through the use of lead or a grooved connection with the stack section.

Downstream of the nipple 15, as seen in drainage direction of the liquid and solids exiting the hole 4, is a full port, double spindle ball valve 20. The valve 20 fully opens to the flow of liquid and solids with only a quarter turn on either one of two valve spindles 21 or 22. In this way, the valve may be completely opened or completely closed with a minimum of motion. The valve spindle 21 has two flat sections 23 and the valve spindle 22 has two flat sections 24, perpendicular to the plane of the paper in FIG. 3. A hole 41 in a wrench 40 shown in FIG. 4 has the same cross section as the valve spindles. The hole 41 is placed over one of the valve spindles 21 or 22 so that the ball valve may be opened or closed. The wrench 40 has a tooth 42 which is narrower than the body of the wrench as seen in the direction perpendicular to the plane of FIG. 3. Stops 25, 26 on the housing of the ball valve 20 are struck by the tooth 42 and prevent the wrench from turning the valve spindles more than one quarter turn, so that the ball valve is not inadvertently opened and closed in one motion. Such a ball valve is constructed like the Apollo 78-100/200 series and the Conbraco 78-255 ball valve, with two valve spindles.

Downstream of the ball valve 20 is a check valve 30 having a bonnet 31. A collar 32 is used to screw the device 10 into the hole 4 with a pipe wrench. The check valve, which is optional, prevents the device 10 from being used for draining plumbing fixtures into the stack. The check valve may be constructed like the Nibco class 150 check valve.

Second connecting means in the form of a nipple 35 with a male thread 36 is disposed downstream of the collar 32 as an outlet. The nipple may have a diameter of approximately 1½ inches, if the nipple 15 has a diameter of approximately 3–4 inches. Finally, a cap 37 is provided with a non-illustrated female thread to be screwed onto the thread 36. A chain may be connected between the cap 37 and the wrench 40 in order to ensure that the wrench will always be available to open the ball valve.

When the cap 37 is removed as shown, a hose 38 may be placed on the thread 36. The cord "hose" is intended to include pipes, tubes or containers of any type. The hose 38 is attached to the nipple 35 in the same manner as the cap 37. However, any connection other than a screw connection for elements 37 and 38 is also conceivable. The ball valve 20 is opened after the hose is attached, so that liquid and solids in the stack may be drained through the hose in a controlled manner before the clog is removed downstream of the clean-out hole 4.

A collar 39 which is shown in phantom, indicates that the nipple 15 may have a male thread which is screwed into a female thread in the collar 39. Therefore, if the nipple 15 is connected to the stack in such a manner as to make it difficult to remove, such as by welding or gluing, the standing liquid and solids may be removed through the hose and then the collar 39 may be turned with a pipe wrench to remove all of the drainage device 10 from the stack except for the nipple 15. In this way the clog may be cleared through the nipple 15. Naturally, the collar and the neck between the nipple 15 and the collar 39 may be as wide as the nipple.

I claim:

1. In a plumbing drainage system having a plumbing stack with a clean-out hole formed therein, a drainage device for controlled drainage of the plumbing stack, the drainage device comprising first means for connecting the drainage device to a plumbing stack at a clean-out hole formed in the plumbing stack, a shut-off valve connected downstream of said first connecting means, a check valve connected downstream of said shut-off valve, and second connecting means connected downstream of said check valve for connection to a drainage hose.

2. Plumbing drainage system according to claim 1, wherein said shut-off valve is a ball valve.

3. Plumbing drainage system according to claim 2, wherein said shut-off valve has two valve spindles.

4. Plumbing drainage system according to claim 1, wherein said first connecting means is a nipple to be connected into the clean-out hole.

5. Plumbing drainage system according to claim 4, wherein said nipple has a male thread to be screwed into a female thread in the clean-out hole.

6. Plumbing drainage system according to claim 1, including a cap to be screwed onto said second connecting means.

7. Plumbing drainage system according to claim 1, including means for separating said first connecting means from said shut-off valve.

8. Combination plumbing stack with a clean-out hole formed therein and a drainage device for controlled drainage of the plumbing stack, the drainage device comprising first means for connecting the drainage device to the plumbing stack at the clean-out hole formed in the plumbing stack, a shut-off valve connected downstream of said first connecting means, a check valve connected downstream of said shut-off valve, and second connecting means connected downstream of said check valve for connection to a drainage hose.

9. Plumbing drainage device for controlled drainage of a plumbing stack having a clean-out hole formed therein, comprising first means for connecting the drainage device to the plumbing stack at the clean-out hole formed in the plumbing stack, a shut-off valve connected downstream of said first connecting means, a check valve connected downstream of said shut-off valve, and second connecting means connected downstream of said check valve for connection to a drainage hose.

10. Plumbing drainage device according to claim 9, wherein said shut-off valve is a ball valve.

11. Plumbing drainage system according to claim 9, wherein said first connecting means is a nipple to be connected into the clean-out hole.

12. Plumbing drainage device according to claim 11, wherein said nipple has a male thread to be screwed into a female thread in the clean-out hole.

13. Plumbing drainage device according to claim 9, including a cap to be screwed onto said second connecting means.

14. Plumbing drainage device according to claim 9 including means for separating said first connecting means from said shut-off valve.

15. Plumbing drainage device for controlled drainage of a plumbing stack having a clean-out hole formed therein, comprising first means for connecting the drainage device to the plumbing stack at the clean-out hole formed in the plumbing stack, a shut-off valve having two valve spindles and being connected downstream of said first connecting means, and second connecting means connected downstream of said shut-off valve for connection to a drainage hose.

* * * * *